US005996587A

United States Patent [19]

White

[11] Patent Number: 5,996,587

[45] Date of Patent: Dec. 7, 1999

[54] SMOKING ARTICLES

[76] Inventor: Peter Rex White, 20 Duttons Road, Romsey, Hampshire, SO51 8DR, United Kingdom

[21] Appl. No.: 08/624,596

[22] PCT Filed: Oct. 13, 1994

[86] PCT No.: PCT/GB94/02245

§ 371 Date: Aug. 28, 1996

§ 102(e) Date: Aug. 28, 1996

[87] PCT Pub. No.: WO95/10951

PCT Pub. Date: Apr. 27, 1995

[30] Foreign Application Priority Data

Oct. 19, 1993 [GB] United Kingdom ..... 9321536

[51] Int. Cl.[6] ..... A24F 5/04

[52] U.S. Cl. ..... 131/198.1; 131/198.2; 131/338

[58] Field of Search ..... 131/198.2, 198.1, 131/338, 336, 360, 215 B, 263

[56] References Cited

U.S. PATENT DOCUMENTS 3,713,452 1/1973 D'Elia et al. ..... 131/198.2
4,174,719 11/1979 Martin et al. ..... 131/10 A

FOREIGN PATENT DOCUMENTS 0514804 11/1992 United Kingdom ..... 131/198.2

*Primary Examiner*—John G. Weiss
*Assistant Examiner*—Charles W. Anderson

[57] ABSTRACT

Smoking articles, cigarettes for example, having a tar delivery of not more than 6 mg a filter ventilation of at least 50% and a ventilation zone located not less than 75% of the length of the filter from the mouth and thereof exhibit enhanced mainstream smoke water-to-tar ratios.

5 Claims, No Drawings

SMOKING ARTICLES

The subject invention relates to smoking articles.

Smokers of low tar delivery cigarettes have reported that the mainstream smoke therefrom is of a dry character.

It is an object of the subject invention to provide low tar delivery cigarettes which exhibit an enhanced mainstream smoke water-to-tar ratio.

According to the present invention, a smoking article comprises a smoking material rod and a filter, the NFDPM (Nicotine Free Dry Particulate Matter) delivery of the article being not more than about 6 mg under standard machine smoking conditions, the filter being ventilated to at least a 50% ventilation value, characterised in that the ventilation zone of the filter is located not less than about 75% of the length of the filter from the mouth end thereof, and that said article exhibits an enhanced mainstream smoke water-to-tar ratio (×100) of at least 6.

Preferably, the ventilation level of the inventive smoking article is at least 60%. It is also preferable that the ventilation zone is located not less than about 80% of the length of the filter from the mouth end thereof. Advantageously, the ventilation zone is located at least 20 mm from the mouth end of the filter and it may be located 24 mm or more from the mouth end.

Advantageously, the filter is a mono-filter and is of, substantially at least, homogenous internal constitution throughout its length. It may comprise as filtration material fibrous cellulose acetate tow.

When cigarettes are smoked at standard (ISO) machine smoking conditions, the smoking machine takes a 35 cc puff of 2 seconds duration in each minute. The degree of ventilation is taken to be the percentage of the 35 cc puff volume which is constituted by ventilation air.

As used herein the term "tar" means total Nicotine Free Dry Particulate Matter of the mainstream smoke, (NFDPM). It is measured according to a standard procedure at standard machine smoking conditions and with the use of a Cambridge filter pad. Preferably, the NFDPM delivery of smoking articles according to the subject invention is not more than about 5.5 mg. It may be as low as 2 to 3 mg.

The ventilation of cigarettes according to the subject invention may be provided by mechanical, laser or electrostatic means and may take the form of a single row of holes extending circumferencially of the filter or of a wider zone of perforation openings. If such zone is of significant width, i.e. that dimension extending lengthwise of the filter, the air flow rate will be higher towards the side of the zone nearer the mouth end of the filter and lower towards the other end. In such cases the distance of the zone from the mouth end of the filter is taken to be the distance taken from the mouth end to the effective ventilation mid-point, this latter being the location in the ventilation zone whereof the total ventilation air flow per unit time upstream of the location is equivalent to the total ventilation air flow per unit time downstream of the location.

EXAMPLE

Control cigarettes and cigarettes according to the subject invention had the following features in common.

Tobacco: Virginia Tobacco

Tobacco rod lengths: 67 mm

Filter type: Cellulose Acetate Mono-Filter

Filter length: 27 mm

Ventilation type: On-Machine Laser : Single line

Ventilation (%): 60%

For the control cigarettes the ventilation line was located at 12 mm from the mouth end of the filter, whereas for the cigarettes according to the subject invention the ventilation line was located at 25 mm from the mouth end of the filter.

The tar deliveries of the control and inventive cigarettes were 5.30 and 5.80 (mg/cigarette) respectively. The water deliveries were 0.25 and 0.43 (mg/cigarette) respectively. Thus, whereas the water-to-tar ratio (×100) of the control cigarettes was 4.70, that for the inventive cigarettes was 7.40.

Smokers reported that the quality of the mainstream smoke of the inventive cigarettes was superior to that of the control cigarettes.

I claim:

1. A smoking article comprising a smoking material rod and a filter, the NFDPM (Nicotine Free Dry Particulate Matter) delivery of the article being not more than about 6 mg under standard machine smoking conditions, the filter being ventilated to at least a 50% ventilation value, characterised in that the ventilation zone of the filter is located not less than about 80% of the length of the filter from the mouth end thereof, and that said article exhibits an enhanced mainstream smoke water-to-tar ratio (×100) of at least 6.

2. An article according to claim 1, wherein the NFDPM delivery thereof is not more than about 5.5 mg.

3. An article according to claim 2, wherein the NFDPM delivery thereof is not more than about 3 mg.

4. An article according to claim 1, wherein said filter is ventilated to at least a 60% ventilation level.

5. A smoking article according to claim 1, said smoking article being a cigarette.

* * * * *

UNITED STATES PATENT AND TRADEMARK OFFICE

CERTIFICATE OF CORRECTION

PATENT NO. : 5,996,587
DATED : December 7, 1999
INVENTOR(S) : Peter Rex White

It is certified that error appears in the above-identified patent and that said Letters Patent is hereby corrected as shown below:

On the cover sheet, after the "[76] Inventor section, insert --[73] Assignee: Brown & Williamson Tobacco Corporation, Louisville, KY--

In the Abstract, line 4, change "and" to --end--;

Signed and Sealed this

Tenth Day of April, 2001

*Attest:*

Nicholas P. Godici

NICHOLAS P. GODICI

*Attesting Officer*

*Acting Director of the United States Patent and Trademark Office*